US008506782B2

(12) United States Patent
Baker et al.

(10) Patent No.: US 8,506,782 B2
(45) Date of Patent: Aug. 13, 2013

(54) ELECTROPHORETIC DEPOSITION OF ADSORBENT MEDIA

(75) Inventors: Charles K. Baker, San Antonio, TX (US); Benjamin R. Furman, San Antonio, TX (US); Joel J. Kampa, Pipe Creek, TX (US); Christopher N. Tiftickjian, San Antonio, TX (US)

(73) Assignee: Southwest Research Institute, San Antonio, TX (US)

( * ) Notice: Subject to any disclaimer, the term of this patent is extended or adjusted under 35 U.S.C. 154(b) by 279 days.

(21) Appl. No.: 12/856,055

(22) Filed: Aug. 13, 2010

(65) Prior Publication Data

US 2012/0114926 A1 May 10, 2012

(51) Int. Cl.
*C25D 13/02* (2006.01)

(52) U.S. Cl.
USPC ..... 204/490

(58) Field of Classification Search
USPC ..... 204/490, 491
See application file for complete search history.

(56) References Cited

U.S. PATENT DOCUMENTS

| | | | | |
|---|---|---|---|---|
| 5,328,580 | A * | 7/1994 | Reamey | 204/484 |
| 5,648,508 | A | 7/1997 | Yaghi | |
| 6,355,793 | B1 | 3/2002 | Lin | |
| 6,893,564 | B2 | 5/2005 | Mueller et al. | |
| 7,318,590 | B2 | 1/2008 | Razavi | |
| 7,343,747 | B2 | 3/2008 | Muller et al. | |
| 7,481,866 | B2 | 1/2009 | MacGillivray et al. | |
| 7,582,798 | B2 | 9/2009 | Yaghi et al. | |
| 8,133,308 | B2 * | 3/2012 | Lively et al. | 96/154 |
| 2003/0099884 | A1 | 5/2003 | Chiang et al. | |
| 2008/0282887 | A1 | 11/2008 | Chance et al. | |
| 2009/0198079 | A1 | 8/2009 | Schubert et al. | |
| 2009/0288952 | A1 | 11/2009 | Olevsky et al. | |
| 2009/0311533 | A1 | 12/2009 | Chen et al. | |
| 2011/0281721 | A1 * | 11/2011 | Bedard | 502/79 |

FOREIGN PATENT DOCUMENTS

| | | |
|---|---|---|
| CA | 2306311 | 10/2001 |

* cited by examiner

*Primary Examiner* — Kishor Mayekar
(74) *Attorney, Agent, or Firm* — Grossman, Tucker et al

(57) ABSTRACT

A method of electrophoretic deposition of adsorbent media onto an electrically conducting substrate. The adsorbent media may include one or more porous coordination polymers and/or one or more secondary adsorbing particles. The adsorbent media may be continuously applied from a liquid composition at a selected thickness and at a controlled rate and as a function of voltage profiles.

13 Claims, 6 Drawing Sheets

*Al-MIL 53 At*
*10,000 X*

*10 μm*

Spherical Carbon Molecular Sieves At 10,000 X

ELECTROPHORETIC DEPOSITION OF ADSORBENT MEDIA

STATEMENT REGARDING FEDERALLY SPONSORED RESEARCH OR DEVELOPMENT

This invention was made with United States Government Support under contract number HR0011-08C-0054 awarded by the U.S. Defense Advanced Research Projects Agency. The Government has certain rights in this invention.

FIELD OF THE INVENTION

The present disclosure relates to a method of electrophoretic deposition of adsorbent media onto an electrically conducting substrate. The adsorbent media may include porous coordination polymers and/or adsorbing particulate. The adsorbent media may be continuously applied from a liquid composition to provide a selected coating thickness and at a controlled rate and as a function of voltage profiles.

BACKGROUND

Adsorption may be understood as the accumulation of atoms or molecules on the surface of a material. Adsorbent materials may include, for example, silica gel, zeolites including natural or synthetic aluminosilicates having a repeating pore network, activated carbon, metal-oxide molecular sieves, activated alumina, carbon nanotubes, pillared clays, inorganic or organic polymers, other porous organic materials and porous coordination polymers, etc. Other adsorbents may include organic networks such as covalent organic frameworks (COFs) or porous coordination polymers including metal organic frameworks (MOFs) which may include, for example, zeolitic imidazolate frameworks. Adsorbent materials may be used in a removal process where certain targeted reagents or molecules may be bound to an adsorbent particle surface either by chemical or physical attraction. Such processes may include, for example, gas storage, gas purification, catalysis or sensors.

SUMMARY OF THE INVENTION

One aspect of the present disclosure relates to a method a method of forming an adsorbent media coating comprising providing an electrically conductive substrate and applying an electrical potential and depositing adsorbent material onto the conductive substrate. The adsorbent material comprises one or a plurality of porous coordination polymers and one or a plurality of secondary adsorbing particles wherein the adsorbent material forms a coating having a thickness of 1.0 micron to 100 microns.

Another aspect of the present disclosure relates to a method for forming an adsorbent media coating comprising providing an electrically conductive substrate and applying an electrical potential and depositing adsorbent material onto the conductive substrate. The adsorbent material comprises one or a plurality of secondary adsorbing particles wherein the adsorbent material forms a coating having a thickness of 1.0 micron to 100 microns.

Another aspect of the present disclosure relates to electrophoretically deposited mixed composition coating comprising porous coordination polymer and/or secondary adsorbing particles wherein said deposit forms a coating having a thickness of 1.0 micron to 100 microns. The porous coordination polymer may comprise one or a plurality of polymers having different chemical structures and the secondary adsorbing particles may also comprise one or a plurality of particles of different chemical composition.

BRIEF DESCRIPTION OF THE DRAWINGS

The above-mentioned and other features of this disclosure, and the manner of attaining them, will become more apparent and better understood by reference to the following description of embodiments described herein taken in conjunction with the accompanying drawings, wherein.

DETAILED DESCRIPTION

Figure 1:
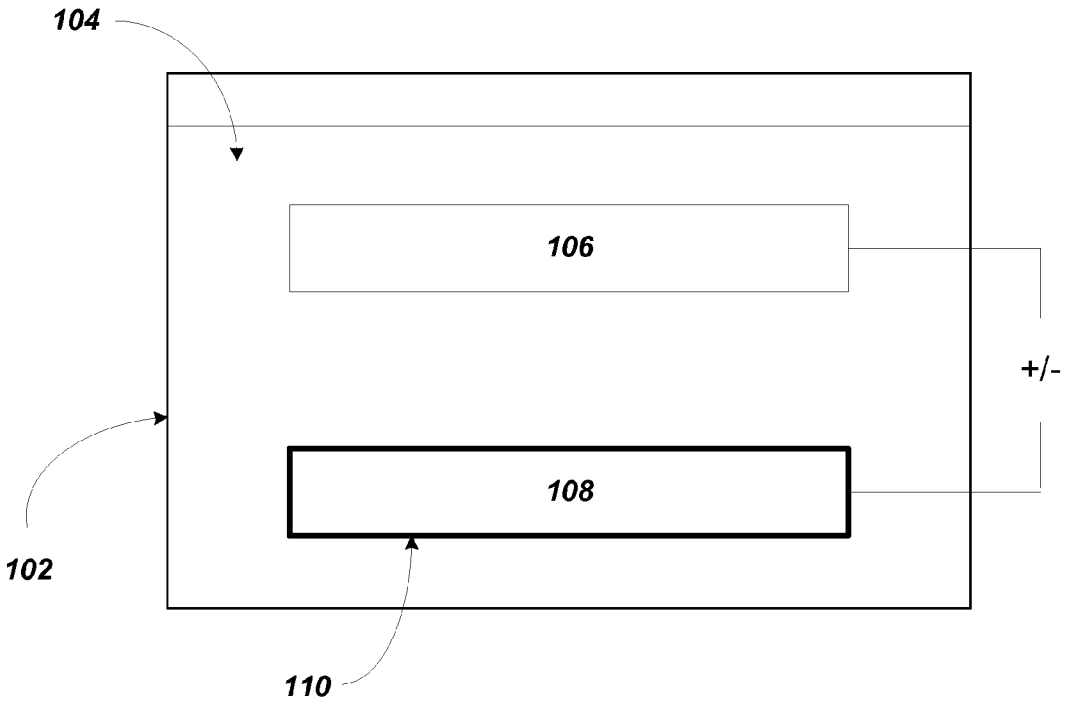
FIG. 1 is an electrophoretic deposition device for the formation of absorbent media onto the indicated electrodes.

The present disclosure relates to a method of electrophoretic deposition of adsorbent media, which may include deposition of certain organic networks, thereby providing films or surface coatings. The organic networks so deposited may then provide for adsorption of other chemical reagents, which may be understood as the accumulation of atoms or molecules within and/or on the surface of a deposited film. The deposited organic networks herein may include secondary adsorbing particles to thereby provide a mixed composition film. Such films may then be utilized, for example, in gas storage, gas purification, catalysis or sensors.

The organic networks may include porous coordination polymers which are capable of electrophoretic deposition. Reference to electrophoretic deposition may be generally understood as a process in which porous coordination polymers, suspended in an organic liquid medium, migrate under the influence of an electric field and are deposited onto an electrode. The porous coordination polymers and/or secondary adsorbing particles may therefore be understood as those polymers or particles that respond to electrophoretic deposition and deposit onto an electrode. In addition, reference to secondary should be understood as a second adsorbing component, and not necessarily an indication of the relative adsorbing capability that may otherwise be present between the selected polymer and selected particulate in a given mixed composition coating.

The porous coordination polymers herein and/or secondary adsorbing particles when deposited may provide for a coating thickness of 1.0 μm to 100 μm, including all values and ranges therein, in 1.0 μm increments. For example, the thickness may be 1.0 μm, 2.0 μm, 3.0 μm, 4.0 μm, 5.0 μm, etc., to 100 μm. Preferably, the thickness may be from 10.0 μm to 75 μm. Reference to porous may be generally understood to refer to any type or degree of porosity such as openings either partially or completely through an identified adsorber. The porosity may generally fall within the range of 1.0 μm to 100 μm, including all values and ranges therein, in 1.0 μm increments.

Porous coordination polymers herein may be further understood to include metal organic frameworks (MOFs) and/or covalent organic frameworks (COFs). A MOF may be understood herein as a porous organic molecule (carbon containing) compound that includes metal ions or clusters coordinated to the organic molecule to form one-, two and/or three-dimensional structures, which may, as noted, be porous. A COF may be understood herein as a crystalline and porous organic molecule in which there are covalent bonds, sourced from the elements carbon, nitrogen, oxygen, boron and hydrogen. In addition, the porous coordination polymers herein may include zeolitic imidazolate frameworks (ZIFs), which are metal-organic frameworks that may be synthesized as crystals by the copolymerization of either Zn(II) or Co(II) with imidazolate-type links.

In some examples, the organic networks may generally include metal coordination sites interconnected by at least one organic bridging ligand substituted with at least one functional group, such as carboxylates and/or imidazoles. The organic networks may be synthesized by co-precipitation of a metal salt with one or more soluble organic ligands under solvo-thermal conditions (e.g. heat and pressure allowing the use of solvents at temperatures above their boiling points). The resulting materials may bear surface charges that allow for the migration of the material through liquid media under the influence of an applied electric field. In addition, the surface charges may be modified by the introduction of exchangeable ions, such as multivalent metal ions. The charged surface may then be bound together via oppositely charged tethering molecules or particles, resulting in a dielectric composite. The formation of the dielectric composite may be driven by an applied electric field if the liquid medium is a suitably polar solvent that does not interfere with the ion exchange reaction via acid-base chemistry.

The metal coordination site may include metal ions of alkali metals, alkaline earth metals, transition metals as well as metalloids. Alkali metals may be understood to include, for example, lithium, sodium, potassium, rubidium, cesium, etc. Alkaline earth metals may be understood to include, for example, beryllium, magnesium, calcium, strontium, etc. Transition metals may include elements selected from groups 3 through 12 as understood under the International Union of Pure and Applied Chemistry (IUPAC) system. For example, transition metals may include scandium, yttrium, titanium, zirconium, hafnium, vanadium, niobium, tantalum, chromium, molybdenum, tungsten, manganese, rhenium, iron, ruthenium, osmium, cobalt, rhodium, iridium, nickel, palladium, platinum, copper, gold, silver, zinc, cadmium, mercury. Metalloids may be understood to include aluminum, gallium, indium, thallium, silicon, germanium, tin, lead, antimony, arsenic, and bismuth. Examples of the metal ions may include, but is not limited to Mg, $Ca^{2+}$, $Sr^{2+}$, $Ba^{2+}$, $Sc^{3+}$, $Y^{3+}$, $Ti^{4+}$, $Zr^{4+}$, $Hf^{4+}$, $V^{4+}$, $V^{3+}$, $V^{2+}$, $Nb^{3+}$, $Ta^{3+}$, $Cr^{3+}$, $Mo^{3+}$, $W^{3+}$, $Mn^{3+}$, $Mn^{2+}$, $Re^{3+}$, $Re^{2+}$, $Fe^{3+}$, $Fe^{2+}$, $Ru^{3+}$, $Os^{3+}$, $Os^{2+}$, $Co^{3+}$, $Co^{2+}$, $Rh^{2+}$, $Rh^{+}$, $Ir^{2+}$, $Ir^{+}$, $Ni^{2+}$, $Ni^{+}$, $Pd^{2+}$, $Pd^{+}$, $Pt^{2+}$, $Pt^{+}$, $Cu^{2+}$, $Cu^{+}$, $Ag^{+}$, $Au^{+}$, $Zn^{2+}$, $Cd^{2+}$, $Ng^{2+}$, $Al^{3+}$, $Ga^{3+}$, $In^{3+}$, $Tl^{3+}$, $Si^{4+}$, $Si^{2+}$, $Ge^{4+}$, $Ge^{2+}$, $Sn^{4+}$, $Sn^{2+}$, $Pb^{4+}$, $Pb^{2+}$, $As^{+}$, $As^{3+}$, $Sb^{5+}$, $Sb^{3+}$, $Sb^{+}$, $Bi^{5+}$, $Bi^{3+}$, and $Bi^{+}$.

The bridging ligand may include an alkyl group having from 1 to 10 carbon atoms, including all values and increments therein, an aryl group having from 1 to 5 phenyl rings, including all values and increments therein, and/or an alkyl or aryl amine consisting of alkyl groups having from 1 to 10 carbon atoms or aryl group having from 1 to 5 phenyl rings. The ligand may also have bound thereto at least one multidentate functional group "X", such as a bi-dentate, tri-dentate, etc., wherein "X" may include $CO_2H$, $CS_2H$, $NO_2$, $SO_3H$, $Si(OH)_3$, $Ge(OH)_3$, $Sn(OH)_3$, $Si(SH)_4$, $Ge(SH)_4$, $Sn(SH)_4$, $PO_3H$, $AsO_3H$, $AsO_4H$, $P(SH)_3$, $As(SH)_3$, $CH(RSH)_2$, $C(RSH)_3$, $CH(RNH_2)_2$, $C(RNH_2)_3$, $CH(ROH)_2$, $C(ROH)_3$, $CH(RCN)_2$, $C(RCN)_3$, wherein R may be an alkyl group having from 1 to 5 carbon atoms, or an aryl group consisting of 1 to 2 phynel rings and $CH(SH)_2$, $C(SH)_3$, $CH(NH_2)_2$, $C(NH_2)_3$, $CH(OH)_2$, $C(OH)_3$, $CH(CN)_2$, $C(CN)_3$.

Bound to the bridging ligand may be a multidentate functional group, which may include, for example, functional groups which are bidentate, tridentate, etc.

In one example of preparing the films or surface coatings herein, illustrated in FIG. 1, at least one porous coordination polymeric material and/or secondary adsorbing particle, along with at least one solvent, may be added to a deposition bath 102 to form a suspension. The porous coordination polymeric material and/or secondary adsorbing particulate may be present at a concentration of 0.1 g/L to 10 g/L, preferably 1.0 g/L to 5.0 g/L. Optionally, the suspension may include one or more metal salts (such as zinc chloride and/or zinc acetate) present at concentration of $1\times10^{-4}$ mole/L to $1\times10^{-3}$ mole/L. The mixture may be added to or formed within a bath 104 including at least two conductive electrodes 106, 108.

A potential may then be provided between the electrode and a film coating of the porous coordination polymeric material and/or secondary adsorbing particle may be precipitated from the mixture and deposited onto at least one of the electrodes. This deposition may depend on the charge and/or zeta potential (ζ-potential) of the porous polymeric material and/or secondary adsorbing particle. Reference to zeta potential may be understood as the electrokinetic potential of the polymer or particle in the liquid suspension and indicates the relative degree of repulsion that may be present between adjacent or similarly charged polymers and/or secondary adsorbing particles. Suitable ζ-potential values herein may be positive or negative and any achievable potential is contemplated. For example, the ζ-potential may be greater than or equal to 5 mV or in the range of 5 mV to 60 mV.

The film or coating shown generally at 110 may be conformal and/or continuous and/or cohesive and/or adherent. Reference to conformal may be understood as a film with a morphologically uneven surface (e.g. a porous surface) but with a thickness that is relatively constant, such +/−5.0 microns or less. That is, the film thickness may also vary +/−4.0 microns, or +/−3.0 microns, or +/−2.0 microns, or +/−1.0 microns and the film conforms to an underlying substrate geometry. Reference to continuous may be understood as that situation where the film coats all exposed surfaces of the coating electrode. References to cohesive may be understood as that situation where the film has some amount of intermolecular (e.g. non-covalent bonding) charge attraction to the electrode. Reference to adherent is that feature where the film becomes bound to the coating electrode by virtue of its contact with the coating electrode.

As may also be appreciated, the thickness of the film may be controlled by the deposition time and/or the concentration of the porous polymeric material and/or secondary absorber (discussed below) in the indicated solvent. In addition, the rate of deposition may be altered depending upon the potential applied between the electrodes. Generally, one may apply constant voltage potential of −10 V to −80 V, preferably −20 V to −40 V. Preferably then, the voltage may not vary by more than +/−1.0 V.

One may also consider the use of a pulsed voltage, in the range of −65 V to −500 V. Reference to pulsed voltage may be understood as the application of the indicated voltage, in a pulsed sequence, for example, at a fixed or variable frequency. It may also be noted that constant voltage potential may provide a deposition rate of 5 nanograms per second (ng/sec) to 40 ng/sec. Utilizing a pulsed voltage, one may observe a deposition rate that is greater than that of the use of a constant voltage, wherein such increase in deposition rate may be up to about 1.5× improved. For example, one may observe a deposition rate of greater than 40 ng/sec, and more specifically, from greater than 40 ng/sec up to 100 ng/sec.

Figure 2:
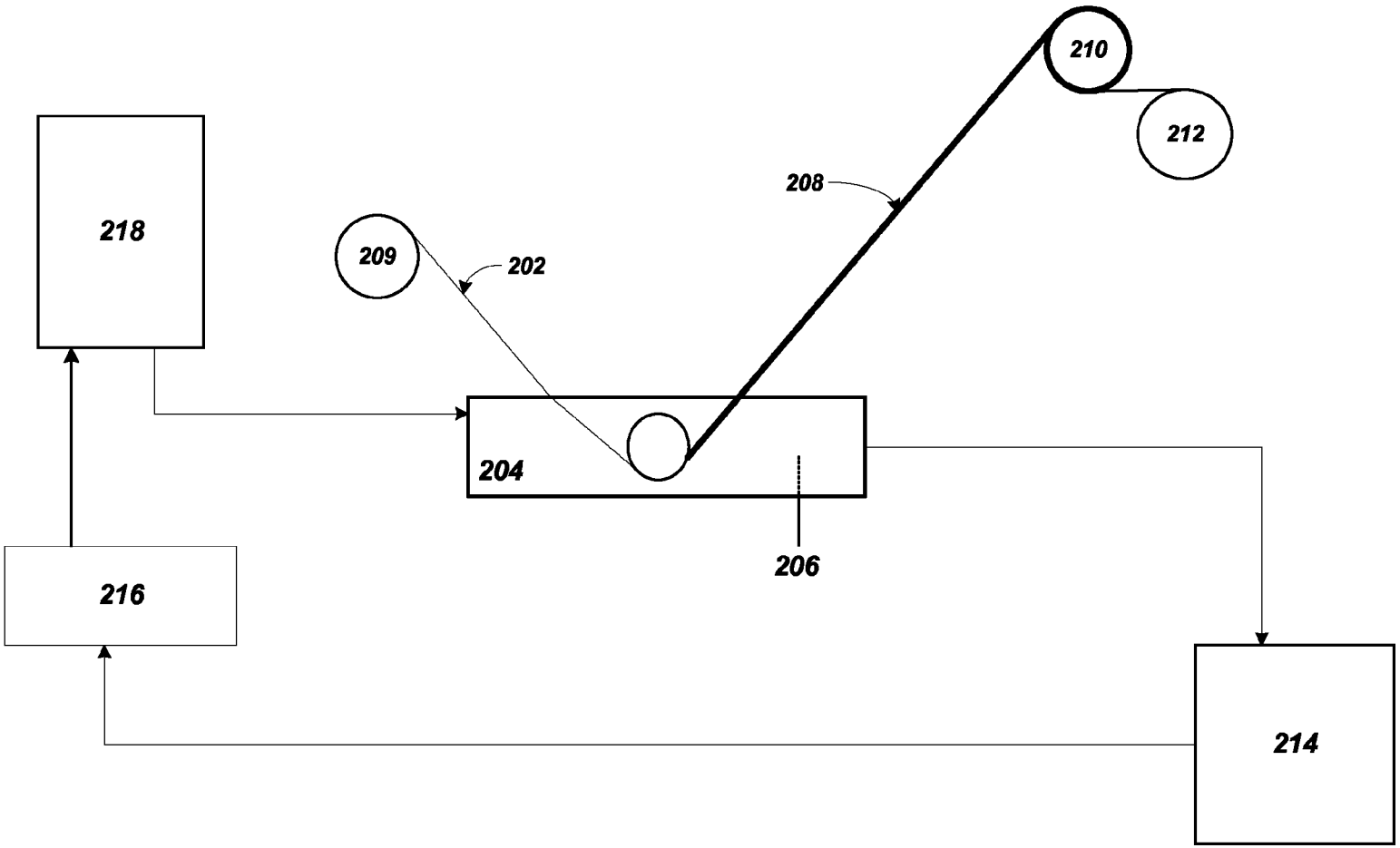
FIG. 2 is an electrophotoretic deposition device for the continuous formation of absorbent media onto a conducting substrate.

In another example, illustrated in FIG. 2, a porous coordination polymeric material and/or secondary adsorbing particle may be continuously applied to a conductive substrate that is in some form of relative motion with respect to a deposition bath. The conductive substrate may be a continuous metallic ribbon or film 202 (e.g. stainless steel) which may be drawn through a deposition bath 204. The bath may include an organic solvent (optionally including a metal salt as noted above), porous coordination polymeric material and/or secondary adsorbing particle to provide a suspension mixture. The organic solvents are preferably polar solvents, which may be understood as those solvents with a dielectric constant of greater than 15. For example, one may utilize acetonitrile ($CH_3CN$) with a dielectric constant of about 37.5 and/or methyl ethyl ketone ($CH_3COCH_2CH_3$) with a dielectric constant of about 18.4. Such solvents are preferably used in the absence of water, i.e. a water level of less than or equal to 100 ppm, e.g. in the range of 1 ppm to 100 ppm. The concentration of the porous polymeric material may be, as noted, in the range of 0.1 g/L to 10 g/L.

The secondary adsorbing particle may be in particulate form, wherein the average size (average diameter) of the particle may be in the range of 10 nm to 10 mm. For example, one may utilize molecular sieves, such a metal-oxide type molecular sieves. One may also utilize molecular sieves which are composed of aluminosilicate polymers which may preferably have an average size range of 1.0 to 5.0 mm, with a nominal pore diameter of 1-5 Angstroms. Reference to a secondary adsorbing particle may therefore be generally understood as any particulate material, capable of adsorption that is separate from the porous coordination polymer noted above.

The secondary adsorbing particles contemplated for use herein may therefore include carbon particles, carbon aerogels, activated carbon (e.g. having surface areas of 500 $m^2/g$ to 1500 $m^2/g$), activated alumina (e.g. having surface area of 200 $m^2/g$-500 $m^2/g$), carbon nanotubes (allotropes of carbon with a cylindrical nanostructure with length-to-diameter ratios of up to 28,000,000:1) and/or clays. Accordingly, the present disclosure provides the ability to form mixed-composition type coatings containing one or more porous coordination polymers and one or more secondary adsorbing particle to thereby enhance the overall adsorption profiles for a given formed film coating for a selected application.

In addition, as alluded to above, the secondary adsorbing particles may be used on their own to provide for the formation of what may be termed a particle film coating. For example, with respect to the secondary particulate adsorber particles noted herein, one may form a particle film coating of carbon particles onto the electrically conducting substrate when a voltage (constant and/or pulsed) is applied to the substrate, in accordance with the voltage profiles noted above and the solvents noted above, which solvents may again optionally include an organic metal salt. As noted, the secondary adsorbing particles may be present in an appropriate solvent at a level of 0.1 g/L to 10 g/L.

In addition, it may now be appreciated that for a given film coating, the porous coordination polymer may be present at a level of 1.0% to 99% by weight, and the secondary adsorbing particles may be present at a level of 99.0% by weight to 1.0% by weight. Within these ranges, the variation may be 1.0% by weight. For example, the porous coordination polymer may be present at a level of 1.0% by weight, or 2.0% by weight, or 3.0% by weight, and the secondary adsorbing particles may be present at the corresponding values of 99% by weight, 98% by weight, 97% by weight, etc. Preferably, the porous coordination polymer may be present at a level of 25% to 75% by weight and the secondary adsorbing particles may be present at a level of 75% by weight to 25% by weight. In addition, the secondary adsorbing particles may also be uniformly distributed. This may be understood as that situation where the secondary adsorbing particles have uniform concentration, and is not concentrated at any one given location of the mixed composition film. For example, should the secondary adsorbing particles be present at a level of 25% by weight in a given mixed composition film coating, it should be noted that at any particular location in such mixed composition film coating, the particles will also typically be present at a level of 25% by weight, +/−1.0% by weight.

The secondary adsorbing particles may also be comprised of porous silica particles comprising organo-siloxane group functionality (—Si—O—Si—) having modified surfaces as well as pore diameters of 1-5 Angstroms. That is, the silicon atom in the above formulated, covalently bonded to oxygen may include pendant organic groups, such as pendant alkyl groups or pendant aromatic groups and/or pendant alkyl-aromatic groups. In particular, the organo-silane may include a tetrafunctional organo-siloxane such as tetraethoxysilane otherwise known as tetraethylorthosilicate (TEOS). The silica particles may have an average size of 10 nanometers (nm) to 10,000 nm. The nominal pore diameters of the silica particles herein may preferably be in the range of 1.0 nm to 1000 nm, more preferably, in the range of 100 nm to 750 nm. The silica particles may also include a functionalized to have a desired amount and type of surface functionality, including acidic or base functionality, to thereby target the attraction and/or absorption of corresponding basic or acidic type compounds. For example, one may react TEOS with 3-aminopropyltriethoxysilane to provide for aminopropyl-modified silica particles. The amine group, so provided, may then attract and absorb corresponding acidic functionality for an amine-acid type interaction.

With attention back to FIG. 2, one electrode is shown generally at 206, and as can be seen, a counter electrode 208 may be positioned at a location removed from the bath but which nevertheless allows for the development of an electrical potential and film coating at such location (i.e. on the conductive substrate 202). That is, an electrical potential may be applied between the conductive substrate 202 and the electrode 206 located in the bath. For example, as illustrated the electrode contact 208 may be provided in electrical communication with the conductive substrate 202 after the substrate leaves the bath. A first supply reel 209 and a take up reel 210 may be provided. The supply reel 209, providing the continuous conducting substrate ribbon or film 202, may then be run through the deposition bath and then to take-up reel 210. The speed at which the conducting substrate may be moved through the bath may be in the range of 0.1 mm/sec to 2.0 mm/sec. Optionally, a release film 212 may be provided from a secondary supply reel 214 and fed between the layers of the continuous ribbon or film 202 developed on the take-up reel 210. The release film may comprise a polymer film such as polyethylene, polypropylene, and/or poly(tetrafluoroethylene).

A feed system may also be provided which continuously supplies the organic network mixture into the bath 204. For example, the bath 204 including the porous coordination polymer and/or secondary adsorbing particle, in suspension, may be provided by a primary reservoir 214 which may optionally pump the bath mixture via pump 216 through an ultrasonic flow cell 218 and into the bath 204. In one example, the bath mixture may then be fed back into the primary reservoir 214 or deposited into a waste tank, once a selected porous coordination polymer and/or secondary adsorbing particle is precipitated as a film coating.

It may be appreciated from the above description of FIGS. 1-2 that one may now electrophoretically deposit one or a plurality of porous coordination polymers onto the electrically conducting substrate as well as one or a plurality of secondary adsorbing particles. For example, one may deposit two or more types of porous coordination polymers (e.g. polymers with different chemical structure such as different repeating unit structure) by utilizing a different deposition bath for the selected electrode configuration. One may therefore deposit one porous coordination polymer containing one type of secondary adsorbing particles, which is not allowed to dry, followed by deposition of a second porous coordination polymer which may then optionally contain a second type of secondary adsorbing particles. One may also deposit one porous coordination polymer containing two or more types of secondary adsorbing particles (e.g. particles having different chemical composition) e.g., molecular sieves and silica particles, which silica particles, as noted, may include a functionalized surface.

EXAMPLES

Example 1

Figure 3:
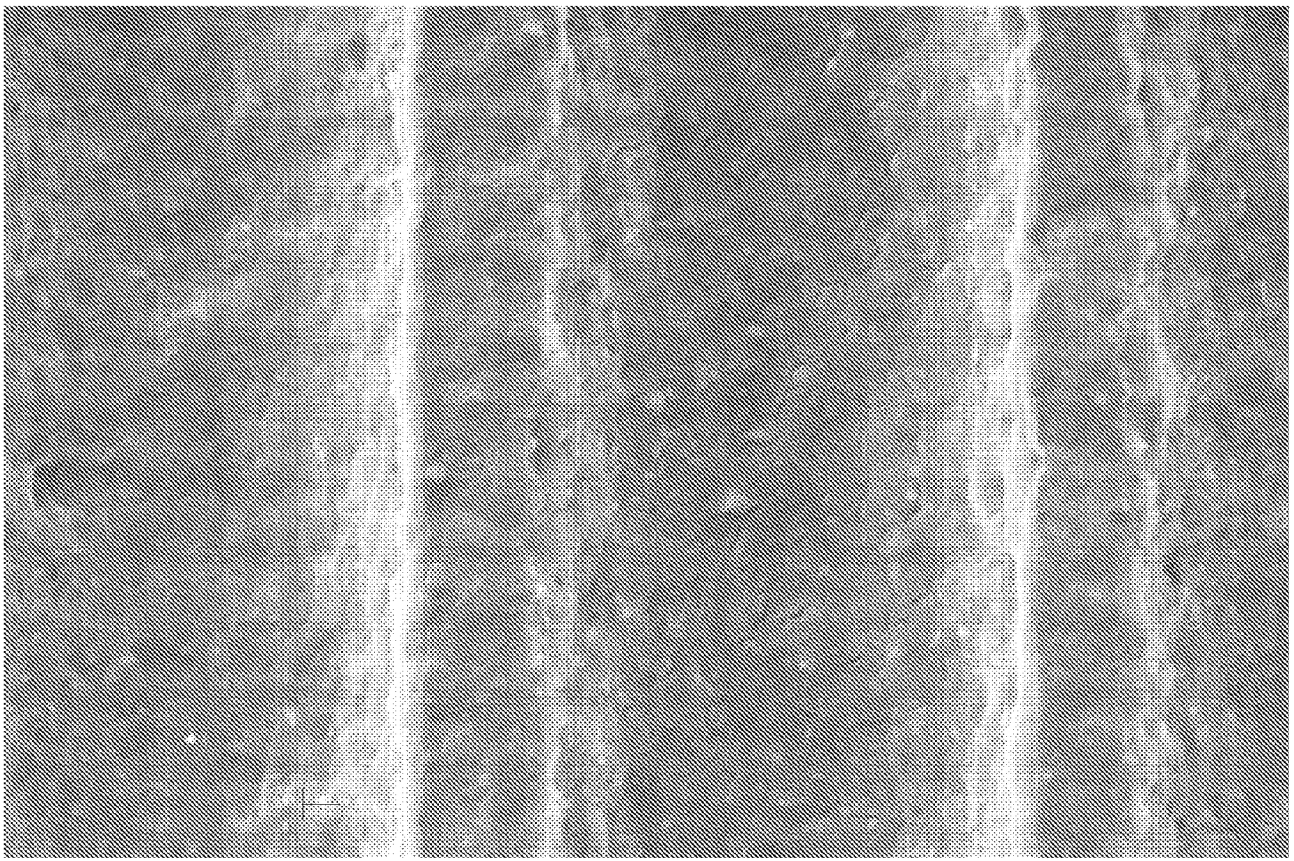
FIG. 3 is an electrophoretic deposited film of Al-MIL 53 at 10,000× magnification.

A suspension containing the metal organic framework (MOF) coordination polymer, AL-MIL-53 (aluminum terephthalate), commercially available as Basolite A-100, with a formula of $C_8H_5AlO_5$, 1.0 g/L) in a solution of $ZnCl_2$ ($5\times10^{-4}$ mole/L) in acetonitrile was placed in a vessel containing two stainless steel plate electrodes. A potential of −60 volts was applied to the to the electrodes such that the electrical field strength was approximately 54 V/cm. This resulted in an electrophoretic deposition of a conformal, continuous, cohesive and adherent film whose thickness may be controlled by the deposition time and solution concentration, onto the negative charged cathode. FIG. 3 shows the electrophotoretically deposited film of AL-MIL-53 on a stainless steel substrate. The stainless steel substrate was 125 microns wide with semi-circular channels spaced 25 microns apart. The channels had a depth of 65 microns. The thickness of the conformal film was approximately 10 microns.

Example 2

Figure 4:
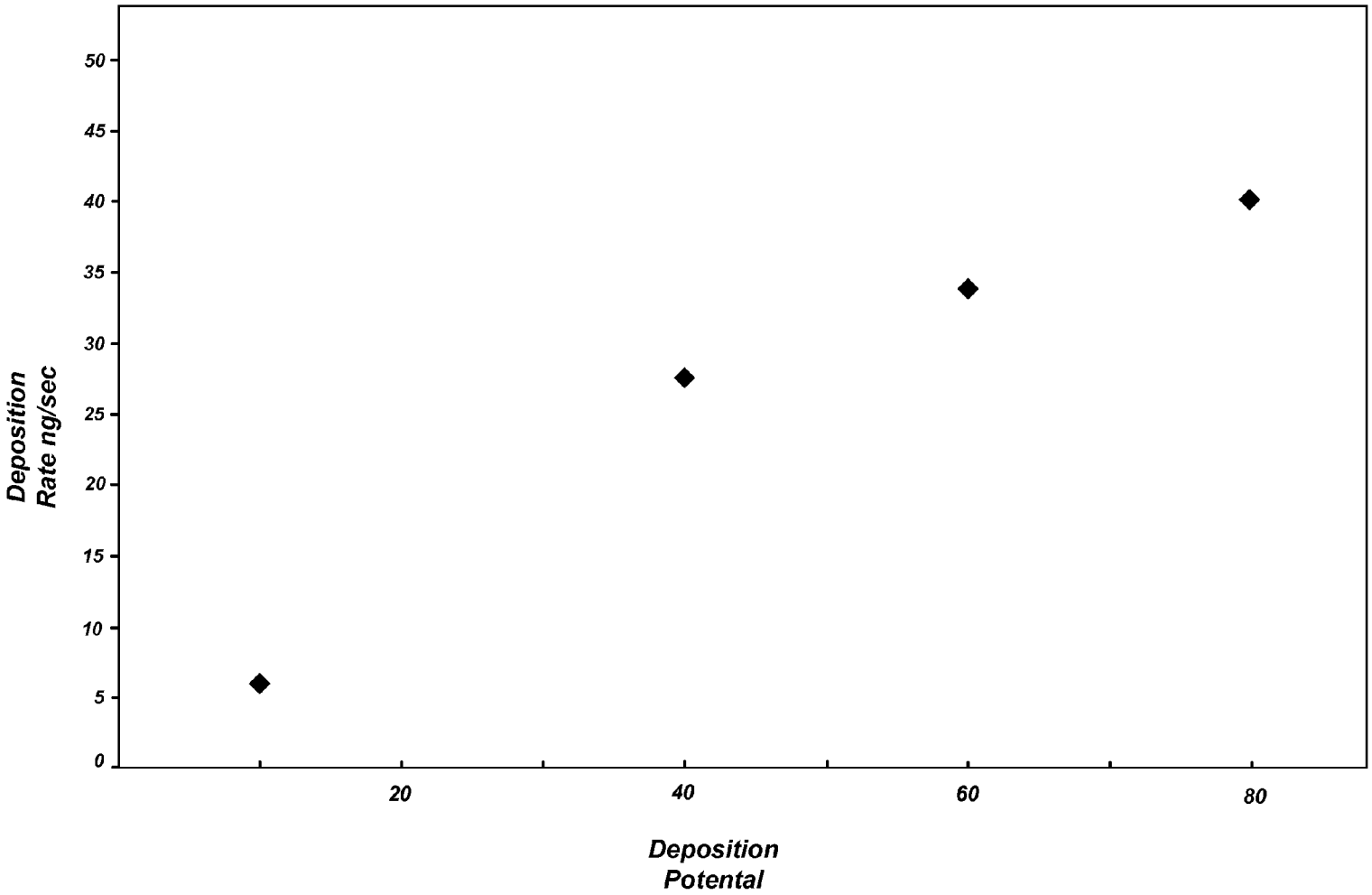
FIG. 4 shows the rate of deposition in nanograms per second (ng/sec) as a function of applied potential.

A suspension containing the MOF coordination compound (AL-MIL-53) at 0.25 g/L in a solution of $ZnCl_2$ in acetonitrile was placed in a vessel containing electrochemical quartz crystal microbalance (EQCM) with a gold coated crystal and stainless steel plate counter electrode. Potentials ranging from −10 to −80 volts were applied to the gold EQCM electrode such that the electric field strength was varied from 6.7 V/cm to 54 V/cm. This resulted in the deposition of a particulate film whose mass can be calculated from the change in frequency for the QCM crystal. FIG. 4 shows the rate of deposition in nanograms per second (ng/sec) as a function of applied potential.

Example 3

A suspension containing MOF coordination compound AL-MIL-53 (1.0 g/L) in a solution of $ZnCl_2$ ($5\times10^{-4}$ mole/L) in acetonitrile was placed in a vessel containing two stainless steel plates. A repetitively pulsed potential profile comprising the application of −54 V/cm for 990 milliseconds followed by +4.5 V/cm for 10 milliseconds was applied to the deposition electrode. This resulted in the electrophoretic deposition of a conformal, continuous, cohesive and adherent particulate film at a rate faster than the application of a continuous potential of −54/Cm V.

Example 4

Figure 5:
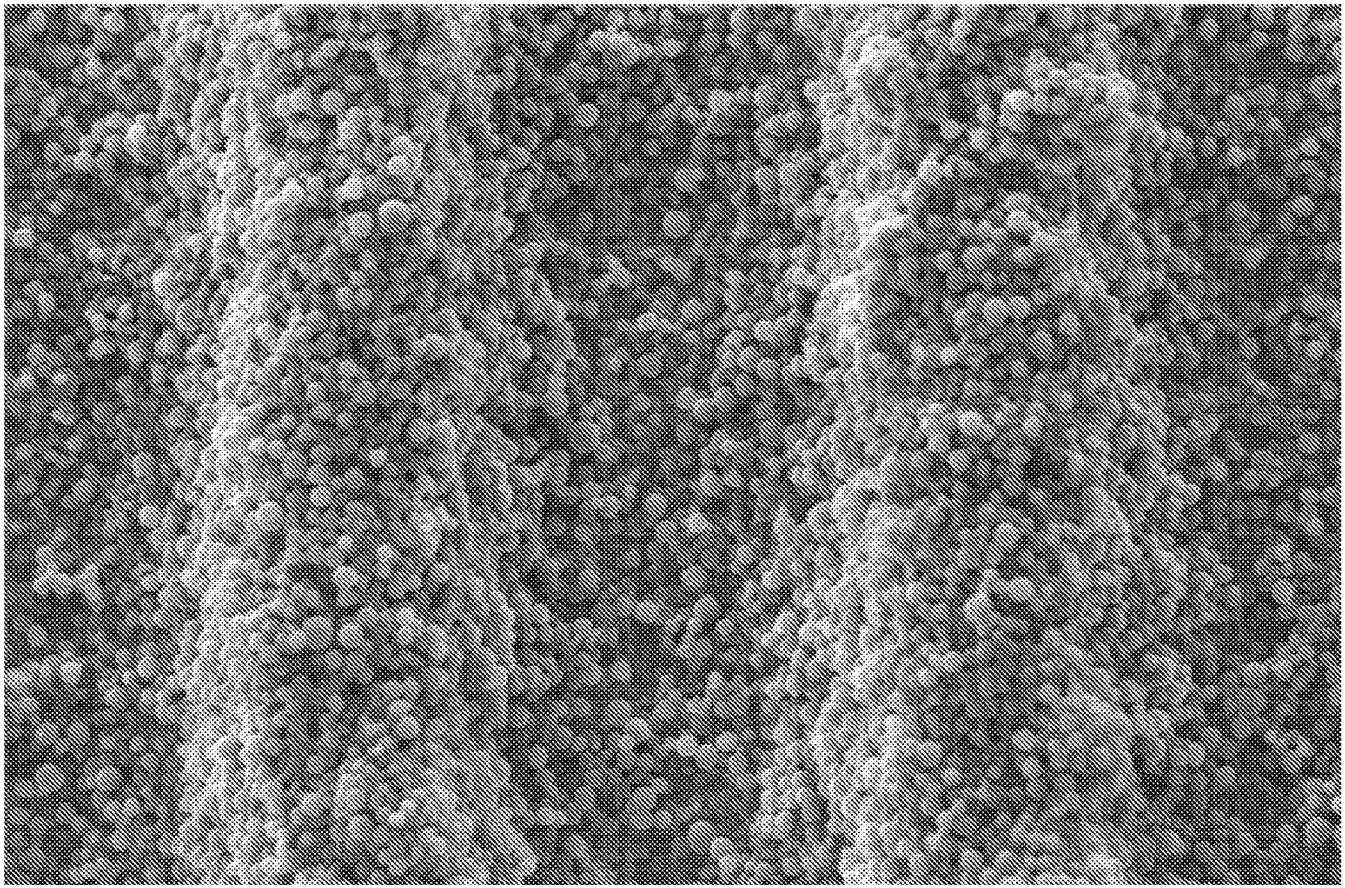
FIG. 5 shows the electrophoretically deposited film of spherical carbon molecular sieves on a stainless steel substrate.

A suspension containing spherical carbon molecular sieves (1.0 g/L) and $ZnCl_2$ ($5\times10^{-4}$ mole/L) in acetonitrile was placed in a vessel containing two stainless steel plates. A potential of −60 V was applied to the electrodes such that the electrical field strength was approximately 54 V/cm. This resulted in electrophoretic deposition of a conformal, continuous film, whose thickness can be controlled by the deposition time and solution concentration, onto the negative charged electrode (cathode). FIG. 5 shows the electrophoretically deposited film of spherical carbon molecular sieves on a stainless steel substrate. The stainless steel substrate was 125 microns wide with semi-circular channels spaced 25 microns apart. The channels had a depth of 65 microns. The thickness of the conformal film was approximately 5-10 microns.

Example 5

Figure 6:
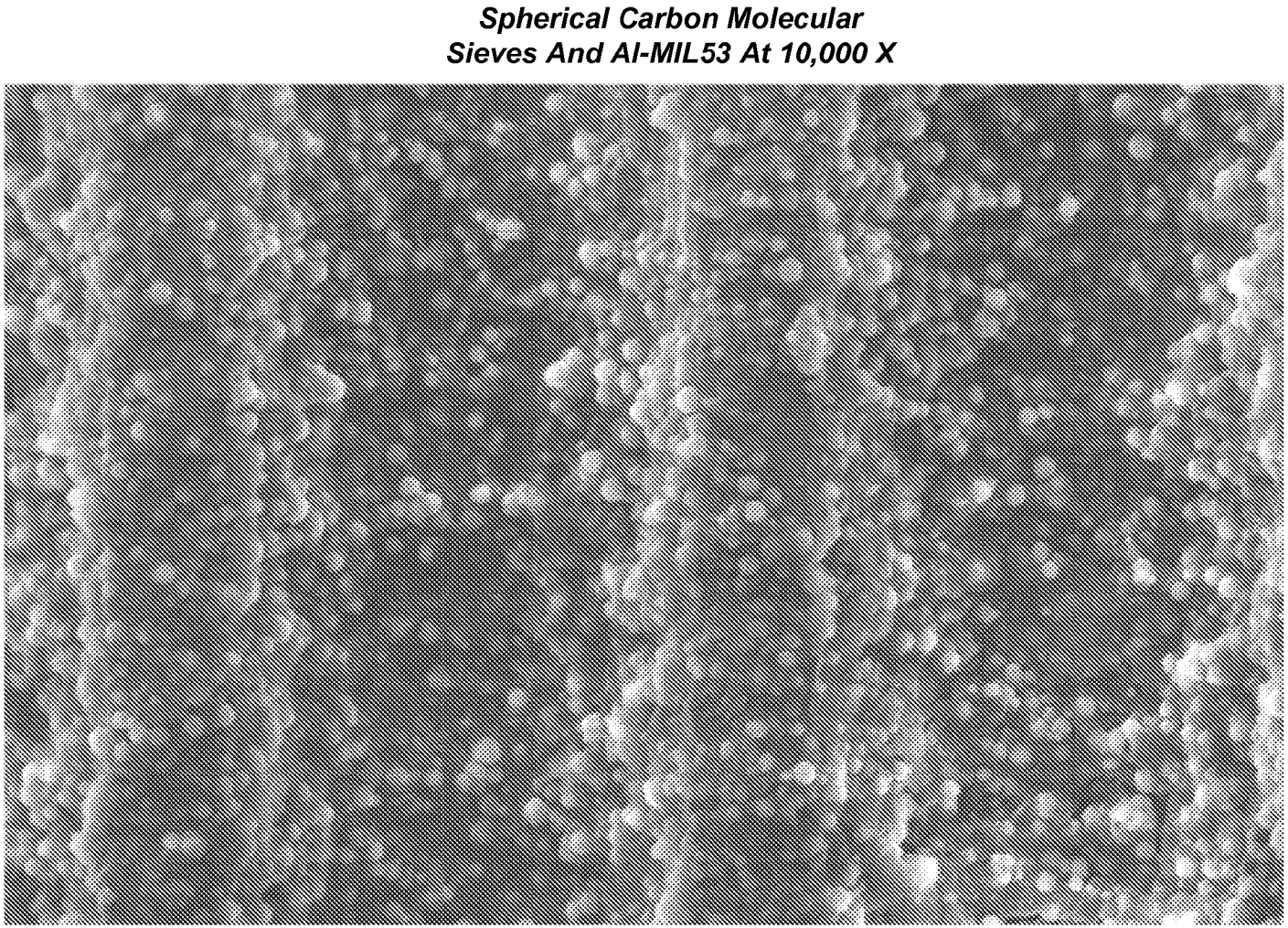
FIG. 6 shows an electrophoretically deposited film of AL-MIL-53 co-deposited with spherical carbon molecular sieves on a stainless steel substrate.

A suspension containing spherical carbon molecular sieves and the MOF compounds AL-MIL-53 at a ratio of 3:1, 1:1 and 1:3 (total particulate concentration=1.0 g/L) in acetonitrile was prepared and placed in a vessel containing two stainless steel plates. A potential of −60 V was applied to the electrodes such that the electric field strength was approximately −54 V/cm. This resulted in electrophoretic co-deposition of a conformal, continuous film whose thickness may be controlled by deposition time and solution concentration, onto the negatively-charged electrode (cathode). FIG. 6 shows an electrophoretically deposited film of AL-MIL-53 co-deposited with spherical carbon molecular sieves on a stainless steel substrate. The stainless steel substrate was 125 microns wide with semi-circular channels spaced 25 microns apart. The channels had a depth of 65 microns. The thickness of the deposited and mixed composition film was 5-15 microns. In addition, it was observed that such mixed composition film indicated relatively greater cohesive strength than the individual AL-MIL-53 deposition film and the individual carbon particle film.

Example 6

To synthesize silica nanoparticles with surface amine functionality, ethanol (95 g), water (15 g) and concentrated ammonium hydroxide (2.64 g, 28% by mass in water) were added to a 250 mL round bottom flask with a magnetic stir bar. The mixture was then stirred until the components were homogenously dissolved. Subsequently, tetraethyl orthosilicate (3.9 g, 19 mmoles) and 3-aminopropyltriethyoxysilane (0.039 g, 0.18 moles) were added and the mixture was allowed to stir for 16 hours at room temperature. The resulting cloudy white suspension of nanoparticles were centrifuged for 30 minutes at 4000 rpm to obtain a clear supernatant which was then decanted. The particles were then re-suspended in approximately 120 mL ethanol by ultrasound (1 minute, 50% duty cycle). This procedure of centrifugate and re-suspension was repeated two more times in order to remove the ammonia. The particles were isolated by drying under vacuum at 60° C. for 16 hours.

Example 7

A mixture containing 3.5 parts BANASORB™ 30 (Cbana, Inc) and 1 part aminopropyl-modified silica particles from Example 6 above ($D_{50}$=400 nm, which may be understood as the mean particle size) were suspended in a solution comprising zinc acetate ($1\times10^{-3}$ mole/L) in 2-butanone. BANASORB™ 30 is a metal organic framework (MOF) adsorbent which is indicated to be composed of metal ions, acting as coordination centers, linked together by polymeric organic bridging ligands. The resulting suspension (0.4 g/L) was placed in a vessel containing two stainless steel plates and a potential ranging from 400 volts (360 V/cm) to 800 volts (720 V/cm) was applied to the deposition electrode. This resulted in the electrophoretic co-deposition of a conformal, continuous, cohesive and adherent particle film.

Example 8

A mixture containing 3.5 parts BANASORB™ 30, 1 part spherical carbon molecular sieves, and 1-part aminopropyl-modified silica particles (Example 6) were suspended in a solution containing zinc acetate ($1\times10^{-3}$ mole/L) in 2-butanone. The resulting suspension (0.4 g/L) was placed in a vessel containing two stainless steel plates and a potential ranging form 400 volts (360 V/cm) to 800 volts (720 V/cm) was applied to the deposition electrode. This resulted in the electrophoretic co-deposition of a conformal, continuous, cohesive and adherent particulate film.

Example 9

A mixture containing 3.5 parts BANASORB™ 30, 1 part ZIF-8 (2-methylimidazole zinc) and 1 part aminopropyl-modified silica particles (Example 6) were suspended in a solution consisting of zinc acetate ($1\times10^{-3}$ mole/L) in 2-butanone. The resulting suspension (0.4 g/L) was placed in a vessel containing two stainless steel plates and a potential ranging from 400 volts (360 V/cm) to 800 volts (720 V/cm) was applied to the deposition electrode. This resulted in the electrophoretic co-deposition of a conformal, continuous, cohesive and adherent particular film Example 10

A mixture containing 3.5 parts BANASORB™ 30, 1 part ZIF-8 (freshly prepared) nanoparticles were suspended in a solution consisting of zinc acetate ($1\times10^{-3}$ mole/L) dissolved in 2-butanone. The resulting suspension (0.4 g/L) was placed in a vessel containing two stainless steel plates and a potential ranging from 400 volts (360 V/cm) to 800 volts (720 V/cm) was applied to the deposition electrode. This resulted in electrophoretic deposition of a conformal, continuous, cohesive and adherent particular film.

Example 11

An apparatus was assembled according to FIG. 2. A suspension of Al-MIL-53 (0.1-5 g/L) in a solution containing $ZnCl_2$ in acetonitrile ($1\times10^{-4}$ mole/L) was added to the circulated bath. The voltage conditions, described herein, were then applied to the stainless steel ribbon substrate while moving the ribbon through the deposition bath, using an electrical motor, at a selected rate. The rate of ribbon movement, voltage profile (e.g. constant voltage value or pulsed voltages are disclosed herein) and suspension composition were used to control the thickness of the resulting continuously formed coating.

The foregoing description of several methods and embodiments has been presented for purposes of illustration. It is not intended to be exhaustive or to limit the claims to the precise steps and/or forms disclosed, and obviously many modifications and variations are possible in light of the above teaching. It is intended that the scope of the invention be defined by the claims appended hereto.

What is claimed is:

1. A method of forming an adsorbent media coating comprising:

drawing an electrically conductive substrate through a bath including a polar solvent and a metal salt present in said polar solvent;

applying an electrical potential and depositing adsorbent material onto said conductive substrate, wherein said adsorbent material comprises one or a plurality of porous coordination polymers and one or a plurality of secondary adsorbing particles wherein said one or plurality of porous coordination polymers is present in said polar solvent at a concentration in the range of 0.1 g/L to 10 g/L and said one or plurality of secondary adsorbing particles are present in said polar solvent at a concentration in the range of 0.1 g/L to 10 g/L and said adsorbent material forms a coating having a thickness of 1.0 micron to 100 microns and said porous coordination polymers have a porosity of 1.0 μm to 100 μm.

2. The method of claim 1 wherein the porous coordination polymer comprises one of a metal organic framework or covalent organic framework.

3. The method of claim 2 wherein said metal organic framework comprises metal ions coordinated to an organic molecule to form one, two and/or three-dimensional structures.

4. The method of claim 2 wherein said covalent organic framework comprises a crystalline and porous organic molecule sourced from the elements carbon, nitrogen, oxygen, boron and hydrogen.

5. The method of claim 1 wherein said porous coordination polymer comprises zeolitic imidazolate frameworks.

6. The method of claim 1 wherein the secondary adsorbing particles comprise carbon particles, alumina particles, aluminosilicate polymer particles, silica particles, and/or clay particles.

7. The method of claim 1 wherein the secondary adsorbing particles comprise aluminosilicate polymer particles at a size range of 1.0 to 5.0 mm.

8. The method of claim 1 wherein the secondary adsorbing particles comprise silica particles having an average size of 10 nm to 10,000 nm.

9. The method of claim 1 wherein said porous coordination polymer is present at a level of 1.0% to 99% by weight and said secondary adsorbing particles are present at a level of 99% by weight to 1.0% by weight.

10. The method of claim 1 wherein an electrode is positioned in said deposition bath, and said conductive substrate comprises a deposition electrode and a constant voltage is applied between said electrodes of −10 V to −80V.

11. The method of claim 1 wherein an electrode is positioned in said deposition bath and said conductive substrate comprises a deposition electrode, and a pulsed voltage is applied between said electrodes of −65 V to −500 V.

12. The method of claim 1 wherein said porous coordination polymers comprise a plurality of porous coordination polymers having different chemical structures.

13. The method of claim 1 wherein said secondary adsorbing particles comprises a plurality of particles of different chemical composition.

* * * * *